US008752238B2

(12) United States Patent
Sever et al.

(10) Patent No.: US 8,752,238 B2
(45) Date of Patent: Jun. 17, 2014

(54) VACUUM CLEANER WITH A CORD HOLDER

(75) Inventors: Eduard Sever, Ludesch (AT); Joachim Vedder, Hergensweiler (DE); Franz Huber, Markt Wald (DE); Dragomir Ljubojevic, St. Gallen (CH)

(73) Assignee: Hilti Aktiengesellschaft, Schaan (LI)

( * ) Notice: Subject to any disclaimer, the term of this patent is extended or adjusted under 35 U.S.C. 154(b) by 351 days.

(21) Appl. No.: 13/290,547

(22) Filed: Nov. 7, 2011

(65) Prior Publication Data

US 2012/0117751 A1 May 17, 2012

(30) Foreign Application Priority Data

Nov. 8, 2010 (DE) ..... 10 2010 043 581

(51) Int. Cl.
*A47L 5/00* (2006.01)
*A47L 5/36* (2006.01)

(52) U.S. Cl.
USPC ..... 15/323; 15/327.2

(58) Field of Classification Search
USPC ..... 15/323, 327.2
IPC ..... A47L 5/00,5/36
See application file for complete search history.

(56) References Cited

U.S. PATENT DOCUMENTS

| | | | | |
|---|---|---|---|---|
| 2,145,723 | A | 1/1939 | Holm-Hansen | |
| 3,290,453 | A | 12/1966 | Jensen | |
| 4,809,393 | A * | 3/1989 | Goodrich et al. | 15/323 |
| 4,912,593 | A * | 3/1990 | Iwao et al. | 361/212 |
| 5,014,385 | A | 5/1991 | Bradd et al. | |
| 6,484,349 | B1 * | 11/2002 | Paterson et al. | 15/323 |
| 6,490,754 | B1 * | 12/2002 | Spaulding | 15/323 |
| 7,716,783 | B2 * | 5/2010 | DiPasquale et al. | 15/323 |

FOREIGN PATENT DOCUMENTS

| | | |
|---|---|---|
| CH | 244023 | 8/1946 |
| DE | 94 13 299 | 10/1994 |
| DE | 20 2005 002979 | 4/2005 |
| DE | 10 2004 005 500 | 8/2005 |
| EP | 0293802 A2 | 7/1988 |
| EP | 1 419 723 B1 | 5/2004 |
| EP | 1922969 A2 | 5/2008 |
| JP | 2008 290 788 | 12/2008 |

* cited by examiner

*Primary Examiner* — David Redding
(74) *Attorney, Agent, or Firm* — Davidson, Davidson & Kappel, LLC

(57) ABSTRACT

A vacuum cleaner (11) including a housing (12) and a power cord (22), and also including a cord holder (31) arranged on the housing (12) for purposes of holding the wound-up power cord on the housing (12). The cable holder (31) has for example three holding elements (32, 37, 42), each having a free end section (33, 38, 43) that can be deflected relative to the housing (12).

9 Claims, 2 Drawing Sheets

VACUUM CLEANER WITH A CORD HOLDER

This claims the benefit of German Patent Application DE 10 2010 043 581.3, filed Nov. 8, 2010 and hereby incorporated by reference herein.

The invention relates to a vacuum cleaner having cord holder.

BACKGROUND

Vacuum cleaners comprise electric consumers such as an electric motor as part of a suction source that generates an air current for purposes of vacuuming, for example, dust particles. In order to supply the electric power, so-called power cords are known which can be connected to a mains socket via a connection plug. Once the vacuum cleaner no longer needs to be connected to the mains, the power cord has to be wound up in or on the vacuum cleaner, so that the vacuum cleaner can be easily stowed and does not pose a tripping hazard.

Moreover, so-called hybrid vacuum cleaners are known whose electric consumers are supplied, on the one hand, with mains current via a power cord or, on the other hand, with electric power via chargeable batteries in the case of battery operation. Such a hybrid vacuum cleaner allows the vacuum-cleaning work to be independent of a mains connection. Particularly during battery operation of the hybrid vacuum cleaner, in order for the work to be done efficiently, it is essential that the power cord does not hinder or limit the use of the hybrid vacuum cleaner.

In the household realm, vacuum cleaners are known which have a cord-winding mechanism in the housing of the vacuum cleaner. This internal cord-winding mechanism, which often encompasses a mechanical winding assistance means, drastically reduces the useful volume of the vacuum cleaner. Vacuum cleaners that are used in the industrial realm, for example, in the construction sector, are subject to approval regulations that prescribe, among other things, a certain cross section for the power cord. Such power cords are often relatively stiff, which is why they are normally wound up on the outside of the vacuum cleaners.

European patent specification EP 1 419 723 B1 discloses a vacuum cleaner having a housing and a power cord to supply electric consumers installed in the housing with electric power, and it also has a cord holder to hold the wound-up power cord on the housing. The cord holder comprises two holding elements, each having a free end section, and they form a U-shaped receptacle in order to create a receiving space for the power cord that is to be wound up.

SUMMARY OF THE INVENTION

A drawback of the known approach is that users of such vacuum cleaners usually only wind up the power cord loosely, so that sections of the power cord can still stick out. When the vacuum cleaner is being transported, these protruding sections of the power cord can pose a tripping hazard since they can get caught, for example, on stairwell railings or on door handles. When the vacuum cleaner has to once again be connected to the mains, the wound-up power cord has to be laboriously unwound, which detrimentally delays the use of the vacuum cleaner. Over the course of time, the unwinding of the power cord can cause it to become damaged on the inside or on the outside.

It is an object of the present invention to provide a vacuum cleaner having a cord holder that does not entail the above-mentioned drawbacks and that allows the power cord to be wound up and unwound in a simple manner.

The present invention provides that in the case of at least n−1 holding elements, the free end sections can be deflected towards and away from the housing.

With one hand movement, the user can pull the wound-up power cord off of the cord holder, which considerably improves the handling and the efficiency of the work. The size of the cross section of the power cord is of secondary importance so that the cord holder also lends itself for vacuum cleaners with higher outputs. Even power cords having a large cross section, which are very stiff, can not only be easily wound up onto the cord holder but they are also easy to pull off of the cord holder. Since the unwinding procedure is eliminated, the risk of damage to the power cord is considerably reduced.

Preferably, the cord holder has precisely three holding elements, so that the power cord is wound up onto three points. In this embodiment, a deflectable, free end section is provided on at least two of the holding elements and this makes it easy to remove the wound-up power cord. Moreover, three holding elements ensure that the power cord can be easily wound up.

Preferably, a deflectable, free end section is provided on all three holding elements, which makes it even easier to remove the wound-up power cord.

Preferably, at least the deflectable, free end section of the appertaining holding element is made of a flexible and/or deformable material, which ensures that the free end section can be easily deflected. The stiffness of the flexible and/or deformable material is preferably such that it prevents the power cord from being inadvertently removed or from falling off of its own accord. For instance, rubber is used as the material for the deflectable, free end sections.

In order to configure the free end section of a holding element so that it can be deflected, a covering made of a flexible and/or deformable material is arranged on the body of the holding element, and this covering is made of a relatively stiff material, at least in the area of the appertaining free end section.

As an alternative, the free end section is arranged on the holding element in question by means of a mechanism, thus allowing the free end section to deflect. For example, this mechanism comprises an appropriately designed hinge or the like.

Preferably, the appertaining holding elements are made in their entirety of a flexible and/or deformable material, which facilitates the production of the cord holder.

Preferably, the free end sections of the holding elements are each arranged at a distance from the housing of the vacuum cleaner and are connected to the housing of the vacuum cleaner via connecting sections, whereby each of the free end sections protrudes beyond the connecting sections, at least in certain areas. Thanks to this measure, each holding element has a receptacle for the coils of the power cord, thus ensuring that the power cord can be easily wound up and—with an appropriate configuration of the receptacle thus created—the entire power cord can be securely stowed.

Preferably, the vacuum cleaner has a collecting canister and a suction box that can be arranged on the collecting canister, whereby the cord holder is preferably provided on a housing section of the suction box. The cord holder is thus an integral part of the removable suction box. This advantageously ensures that the power cord that has been wound up or placed on the cord holder does not get in the way when the collecting canister is being emptied or replaced.

Preferably, the suction box encompasses a support edge that straddles a support plane and that can be put into contact with the collecting canister, whereby at least the free end section of a holding element projects beyond this support plane in order to form a support point for the suction box. If a suction box that has been removed from the collecting canister is placed on the ground, the free end section that projects beyond the support plane forms a support point for the suction box in addition to the other support points, so that the suction box can be manufactured in a simple and cost-efficient manner.

Preferably, the housing comprises a cover that, when it is closed, at least partially covers the cord holder, as a result of which the power cord is still easy to handle while, at the same time, it is advantageously protected against dirt and exposure to dust. Moreover, this cover also prevents the power cord from unwinding of its own accord. In the case of a hybrid vacuum cleaner, this cover is advantageously formed by a covering flap that protects the batteries installed in the vacuum cleaner against dirt and dust while still allowing access to these batteries.

Preferably, when the cover is closed, it covers at least two of the holding elements of the cord holder, which ensures that the wound-up cord is advantageously protected and additionally secured. This cover is advantageously configured in such a way that overall, 20% to 90% of the cord volume is covered by the cover. Moreover, the connection plug of the power cord is advantageously covered up by the cover, so that the plug is likewise advantageously protected against dirt and exposure to dust.

BRIEF DESCRIPTION OF THE DRAWINGS

The invention is explained schematically and by way of an example in greater detail on the basis of figures.

The figures are described in relation to each other and as a whole. Identical reference numerals refer to identical components.

Figure 1:
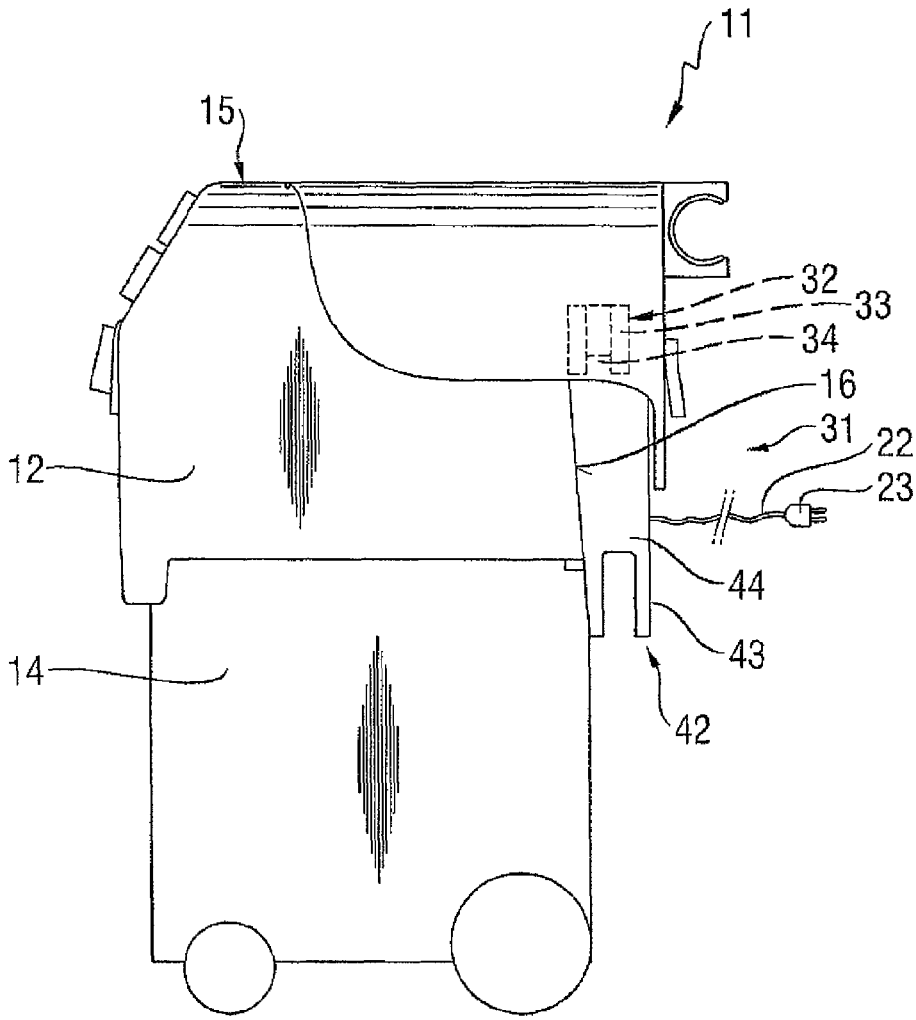
Figure 2:
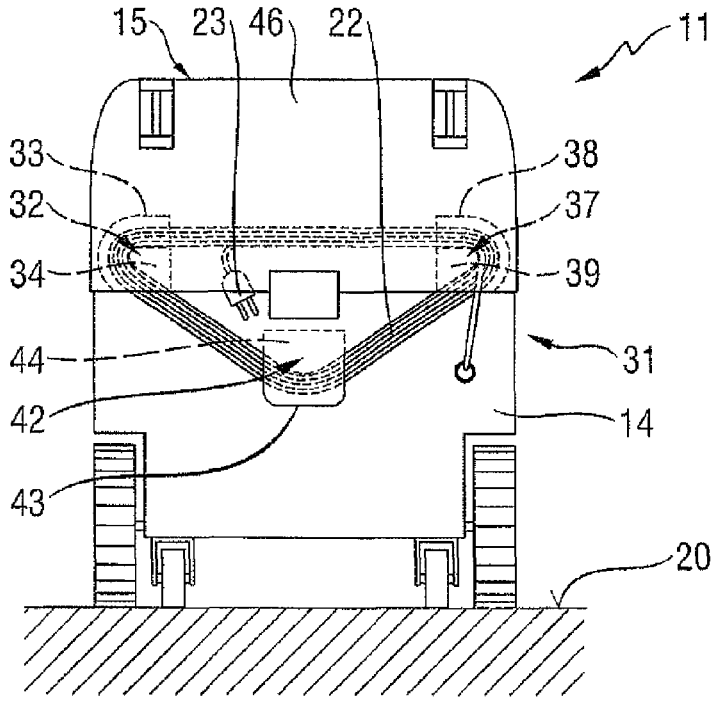
Figure 3:
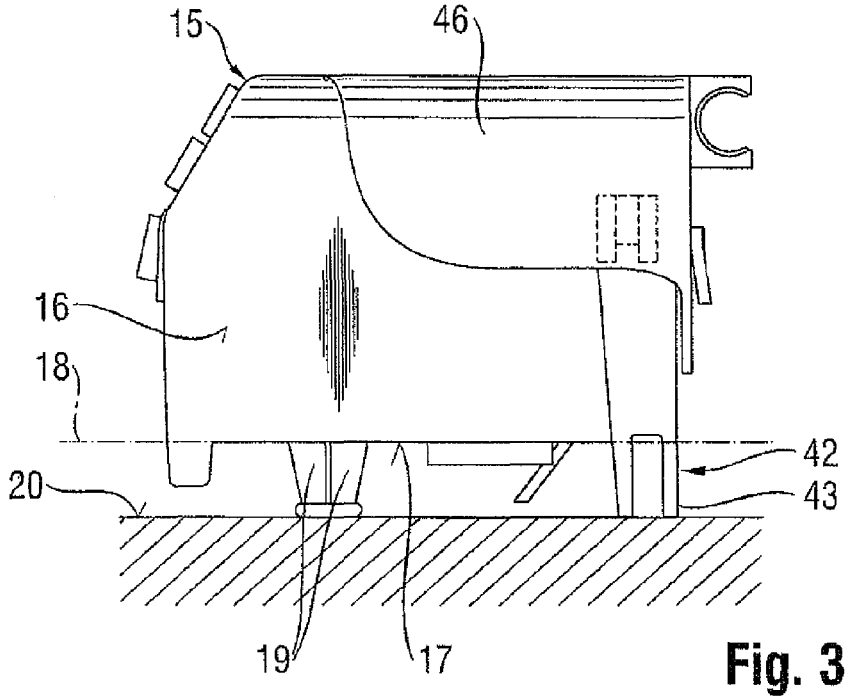

The following is shown:

FIG. 1—a side view of a vacuum cleaner;

FIG. 2—a rear view of the vacuum cleaner in accordance with FIG. 1, with a wound-up power cord;

FIG. 3—a side view of the suction box of the vacuum cleaner in accordance with FIG. 1.

DETAILED DESCRIPTION

The vacuum cleaner 11 shown in FIGS. 1 and 2 is a hybrid vacuum cleaner that can be operated using mains power or batteries. The vacuum cleaner 11 has a housing 12 and a power cord 22 that serves to supply electric power to electric consumers, such as an electric motor, installed in the housing 12. The vacuum cleaner 11 has a collecting canister 14 where the vacuumed dust particles are collected until the time of their disposal, and a suction box is arranged on the collecting canister 14, whereby, among others, the suction source and at least some of the electric consumers are provided in said suction box.

A cord holder 31 that serves to hold the power cord 22 when it is wound up is provided on a housing section 16 of the suction box 15. In this embodiment, the cord holder 31 has three holding elements 32, 37 and 42, each of which having a free end section 33, 38 and 43. In the case of at least two of the three holding elements 32, 37 and 42, the free end sections 33, 38 and/or 43 can be deflected towards and away from the housing. In this embodiment, all of the holding elements 32, 37 and 42 have a deflectable, free end section 33, 38 and 43.

The holding elements 32, 37 and 42 as a whole, and thus also their free end sections 33, 38 and 43, are made of a flexible and/or deformable material, advantageously of rubber.

The free end sections 33, 38 and 43 of the holding elements 32, 37 and 42 are each arranged at a distance from the housing 12 of the vacuum cleaner 11 and are connected to the housing 12 of the vacuum cleaner 11 via connecting sections 34, 39 and 44, whereby each of the free end sections 33, 38 and 43 protrudes beyond the connecting sections 34, 39 and 44, at least in certain areas. As a result, each holding element 32, 37 and 42 has a sufficiently large receptacle for the individual coils of the wound-up power cord 22.

Especially as can be seen in FIG. 3, the suction box 15 has a support edge 17 that straddles a support plane 18 and that can be put into contact with the collecting canister 14. The free end section 43 of the holding element 42 projects beyond this support plane 8, as a result of which this free end section 43 forms—in addition to the other support points 19 formed, for instance, by measuring elements such as water-level sensors—a support point for the suction box 15. The support points 19 and 20 prevent damage to the suction box 15 when it is put onto the ground 20.

A cover made 46 is pivotably affixed to the housing section 16 of the suction box 15, and, when this cover is closed as shown, it covers the two holding elements 32 and 37 of the cord holder 31. The wound-up power cord 22 as well as its connection plug 23 are advantageously protected by the cover 46 against dirt and exposure to dust.

Naturally, the individual details described in conjunction with the figures can also be provided for the other embodiments.

The list of reference numerals presented below as well as the technical teaching of the patent claims are considered as falling within the scope of the disclosure and, either on their own or in combination with the figures, they disclose additional details of the invention and of its embodiments to the person skilled in the art.

LIST OF REFERENCE NUMERALS

11 vacuum cleaner
12 housing
14 collecting canister
15 suction box
16 housing section of 15
17 support edge of 15
18 support plane
19 support point of 15
20 ground
22 power cord
23 connection plug
31 cord holder
32 first holding element
33 free end section of 32
34 connection section of 32
37 second holding element
38 free end section of 37
39 connection section of 37
42 third holding element
43 free end section of 42
44 connection section of 42
46 cover

What is claimed is:

1. A vacuum cleaner comprising:

a housing;

a power cord to supply electric consumers arranged in the housing with electric power; and a cord holder arranged on the housing for holding the power cord in a wound-up state on the housing, the cord holder having n holding elements, n being at least the number two, each holding element having a free end section, at least n−1 holding elements each having the free end section being deflectable towards and away from the housing, a collecting canister; and a suction box arrangable on the collecting canister, wherein the suction box encompasses a support edge straddling a support plane, the support edge contactable with the collecting canister, at least the free end section of a holding element projecting beyond the support plane to form a support point for the suction box.

2. The vacuum cleaner as recited in claim 1 wherein the cord holder has precisely three holding elements.

3. The vacuum cleaner as recited in claim 2 wherein all three holding elements have the deflectable free end sections.

4. The vacuum cleaner as recited in claim 1 wherein at least the deflectable, free end section of the respective holding element is made of a flexible and/or deformable material.

5. The vacuum cleaner as recited in claim 4 wherein the respective holding element is made entirely of the flexible and/or deformable material.

6. The vacuum cleaner as recited in claim 1 wherein the free end sections of the holding elements are each arranged at a distance from the housing of the vacuum cleaner and are connected to the housing of the vacuum cleaner via connecting sections, each of the free end sections projecting beyond the connecting sections, at least in certain areas.

7. The vacuum cleaner as recited in claim 1 wherein the housing includes a housing section of the suction box, the cord holder being provided on the housing section of the suction box.

8. A vacuum cleaner comprising:

a housing;

a power cord to supply electric consumers arranged in the housing with electric power; and a cord holder arranged on the housing for holding the power cord in a wound-up state on the housing, the cord holder having n holding elements, n being at least the number two, each holding element having a free end section, at least n−1 holding elements each having the free end section being deflectable towards and away from the housing, wherein the housing comprises a cover closable to at least partially cover the cord holder.

9. The vacuum cleaner as recited in claim 8 wherein, when the cover is closed, the cover covers at least two of the holding elements of the cord holder.

* * * * *